US005967805A

United States Patent [19]

Auclair et al.

[11] Patent Number: 5,967,805

[45] **Date of Patent: *Oct. 19, 1999**

[54] COMBINATION MESSENGER STRAND GROUND AND CABLE LASHING WIRE CLAMP

[75] Inventors: William T. Auclair, Winsted; Randolph L. Auclair, New Hartford, both of Conn.

[73] Assignee: Electric Motion Company, Inc., Winsted, Conn.

[ * ] Notice: This patent is subject to a terminal disclaimer.

[21] Appl. No.: 09/018,699

[22] Filed: Feb. 4, 1998

Related U.S. Application Data

[60] Division of application No. 08/802,520, Feb. 20, 1997, Pat. No. 5,772,455, which is a continuation-in-part of application No. 08/453,828, May 30, 1995, abandoned.

[51] Int. Cl.[6] ..... H01R 4/66

[52] U.S. Cl. ..... 439/100

[58] Field of Search ..... 439/100, 98, 391, 439/806, 810

[56] References Cited

U.S. PATENT DOCUMENTS

| | | | |
|---|---|---|---|
| 4,325,598 | 4/1982 | Leonardo | 439/98 |
| 4,526,428 | 7/1985 | Sachs | 439/92 |
| 4,623,204 | 11/1986 | Auclair | 439/100 |
| 5,015,205 | 5/1991 | Franks | 439/803 |
| 5,131,856 | 7/1992 | Auclair | 439/100 |
| 5,163,643 | 11/1992 | Auclair | 248/61 |
| 5,772,455 | 6/1998 | Auclair et al. | 439/100 |

*Primary Examiner*—Neil Abrams
*Assistant Examiner*—T C Patel
*Attorney, Agent, or Firm*—Alix, Yale & Ristas, LLP

[57] ABSTRACT

A combination messenger strand ground and cable lashing clamp comprising a jaw for gripping the messenger strand and a clamp assembly which is engageable with the jaw for clamping the jaw to the messenger strand. The jaw and clamp assembly are composed of electrically conductive material. The jaw is comprised of opposingly positioned jaw members. The clamp assembly is comprised of a stud-like member which is received by openings in each jaw member. A flanged portion of the stud engages the first jaw member. A first nut is threadably positionable on the stud to engage the second jaw member. Applying torque to the first nut clamps the second jaw member and the first jaw member together thereby clamping the messenger strand between jaw member claws and causing the jaw member teeth to pierce the messenger strand insulation and engage the messenger strand conductor. A ground connection portion of the stud engages the ground connector and completes the ground connection electrical path through the clamp assembly and jaw to the messenger conductor. The lashing wire is positioned between first and second washers and a second nut is torqued into engagement with the second washer to clamp the lashing wire between the washers.

7 Claims, 7 Drawing Sheets

COMBINATION MESSENGER STRAND GROUND AND CABLE LASHING WIRE CLAMP

This is a divisional application of copending application Ser. No. 08/802,520 filed on Feb. 20, 1997 which was a continuation-in-part of application Ser. No. 08/453,828 filed on May 30, 1995 which is now abandoned.

BACKGROUND OF THE INVENTION

This invention relates generally to devices for implementing a ground connection between a conductor of a cable messenger strand or innerduct on strand and a common ground point. The invention also relates generally to devices for terminating cable lashing wire.

The messenger strand insulation is stripped from the messenger strand to effect a ground connection in conventional installation techniques to which the invention relates. Once the insulation has been removed, a U-shaped bracket is positioned around the strand, a ground wire is positioned in contact with the messenger strand conductor, and the bracket is clamped to the strand.

Such conventional techniques are time consuming and require the use of multiple components. Stripping the insulation may be hazardous to personnel and adversely effect the integrity of the cable and strand.

SUMMARY OF THE INVENTION

Briefly stated, the invention in a preferred form is a ground clamp for connecting a ground lead to a messenger strand or innerduct on strand and for clamping a cable lashing wire. The clamp assembly comprises a jaw for gripping the messenger strand and a clamp assembly which is engageable with the jaw for clamping the jaw to the messenger strand. The jaw and clamp assembly are composed of electrically conductive material. The jaw is comprised of first and second opposingly positioned jaw members having adjacent surfaces. Claws project from the end of each jaw member for grasping the messenger strand. A plurality of teeth project from each side of each member for penetrating the messenger strand insulation and engaging the messenger strand conductor. In one embodiment, at least one projection extends from each side of each member. The projections are located at a distance from the claws such that the messenger strand is clamped between them. The clamp assembly is comprised of a stud-like member which is received by openings in each jaw member. When the ground connector is being terminated at the clamp, a ground connection portion of the stud receives the ground connector and completes the ground connection electrical path through the clamp assembly and jaw to the messenger conductor. A ground connector that is not being terminated at the clamp may be clamped between a clip and one of the jaw members.

An integral flange on the stud defines a stop which is disposed between the ground connection portion and the first jaw member to engage the first jaw member. A first nut, threadably mounted on a first end portion of the stud, is engageable with the second jaw member. Applying torque to the first nut clamps the second jaw member and the first jaw member together whereby the messenger strand is clamped between the first and second jaw members so that the jaw teeth engage the messenger strand conductor. The lashing wire is positioned between a first and second washer located generally opposite to the first end and a second nut may be torqued into engagement with the second washer to clamp the lashing wire to the clamp assembly.

An object of the invention is to provide a new and improved messenger strand ground clamp for implementing a ground connection between the metallic messenger conductor and a common ground point.

Another object of the invention is to provide a new and improved combination messenger strand ground and cable lashing clamp for implementing a ground connection between the metallic messenger conductor and a common ground point and for clamping a lashing wire.

A further object of the invention is to provide a new and improved combination messenger strand ground and cable lashing wire clamp having an efficient construction and which may be installed in an efficient manner.

Other objects and advantages of the invention will become apparent from the drawings and the specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
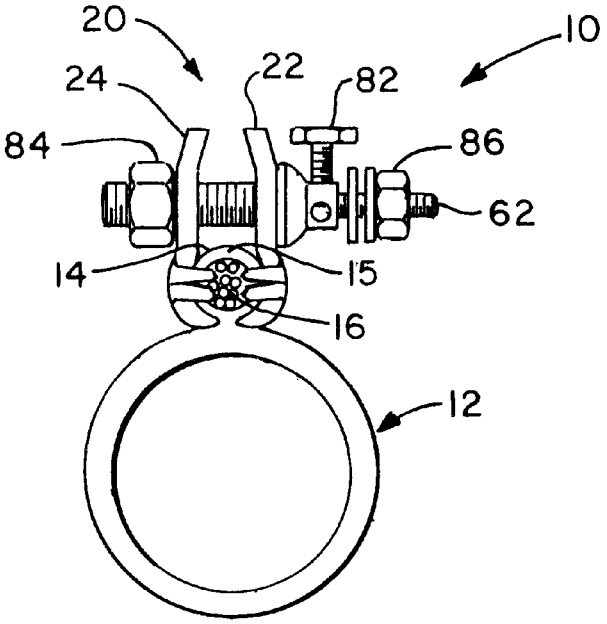
FIG. 1 is a side view of a first embodiment of a combination messenger strand ground and cable lashing wire clamp in accordance with the present invention, illustrated clamped to a cable messenger strand.
Figure 2:
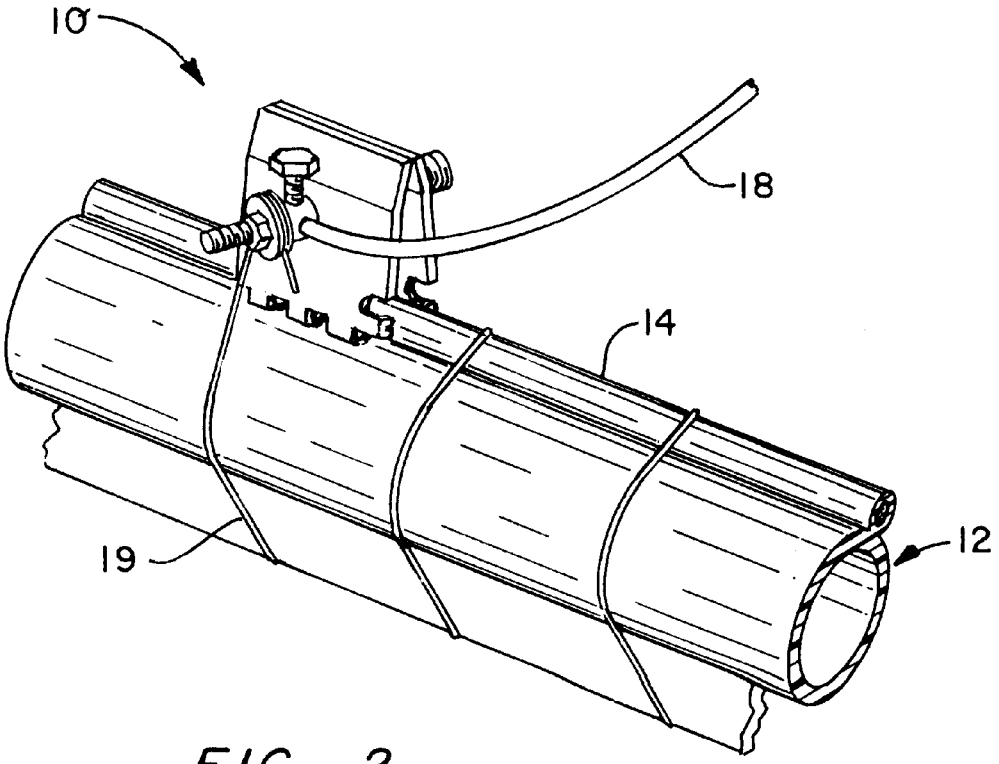
FIG. 2 is a perspective view of the clamp and cable of FIG. 1 together with a ground wire and lashing wire.

With reference to the drawings wherein like numerals represent like parts throughout the several figures, a combination messenger strand ground and cable lashing wire clamp in accordance with the present invention is generally designated by the numeral 10. The clamp 10 is comprised of a jaw assembly 20 which engages the cable messenger strand 14 (FIG. 3) upon the application of torque to a first clamp nut 84, as shown in FIGS. 1 and 2.

Figure 4:
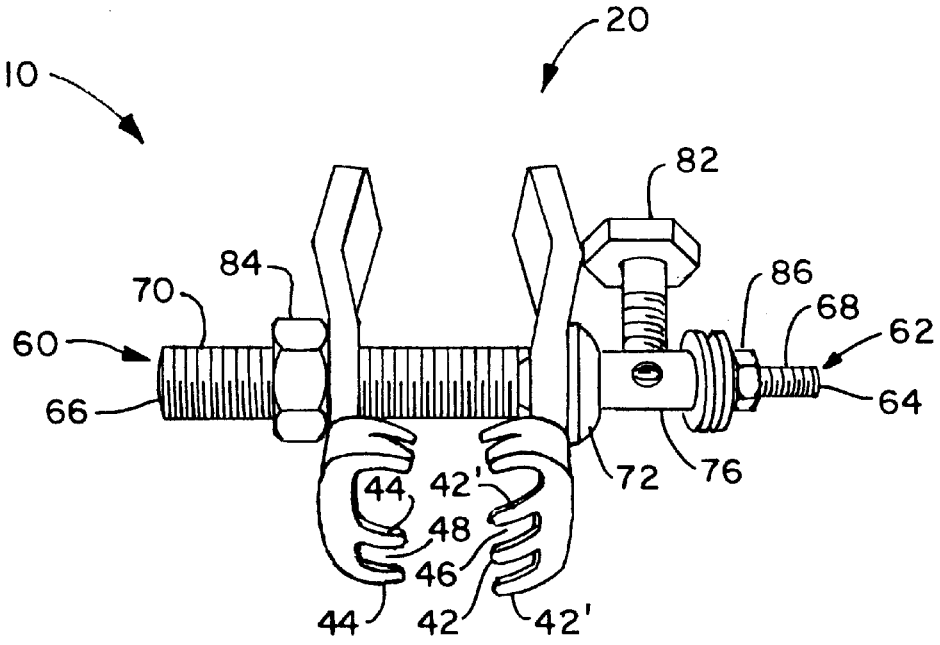
FIG. 4 is a perspective view of the clamp of FIG. 3.
Figure 7:
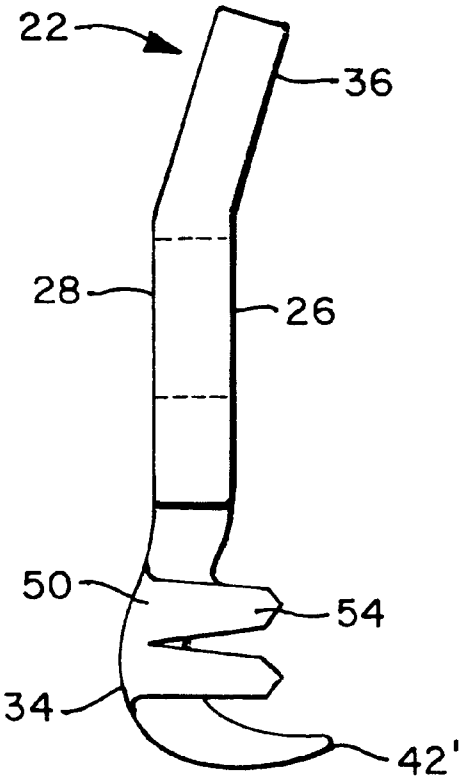
FIG. 7 is a side view, partly in phantom, of the jaw member of FIG. 6.
Figure 6:
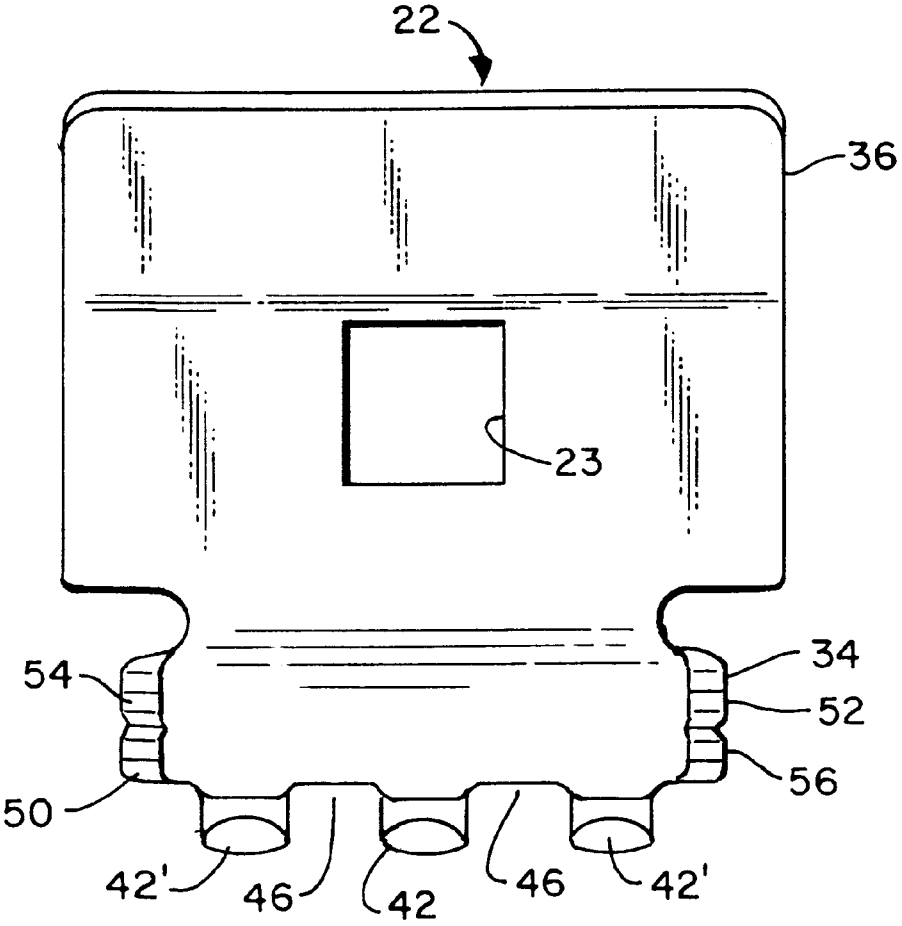
FIG. 6 is an enlarged front view of a jaw member of FIG. 1 viewed from the left thereof.

The jaw assembly 20 is comprised of two cooperating jaw members 22, 24. Each jaw member 22, 24 has first and second opposite surfaces 26, 28, 30, 32 and first and second opposite end portions 34, 36, 38, 40. The first member first surface 26 is adjacent the second member first surface 30. The first end portion 34, 38 of the first and second members 22, 24 each comprise a plurality of claws 42, 44 which extend upwardly relative to the first surface 26, 30. Gaps 46, 48 separate adjacent claws 42, 42', 44, 44'. The first member claws 42 are complementary with the second member claws 44 wherein first member claws 42 are positioned opposite second member gaps 48 and second member claws 44 are positioned opposite first member gaps 46 so that the claws 42, 44 intermesh. In a preferred embodiment, the claws 42, 44 have a slightly arcuate shape, as shown in FIGS. 4 and 7. The arcuate shape allows the claws 42, 44 to engage the messenger strand 14 along a substantial interface rather than along a narrow contact line.

Figure 10:
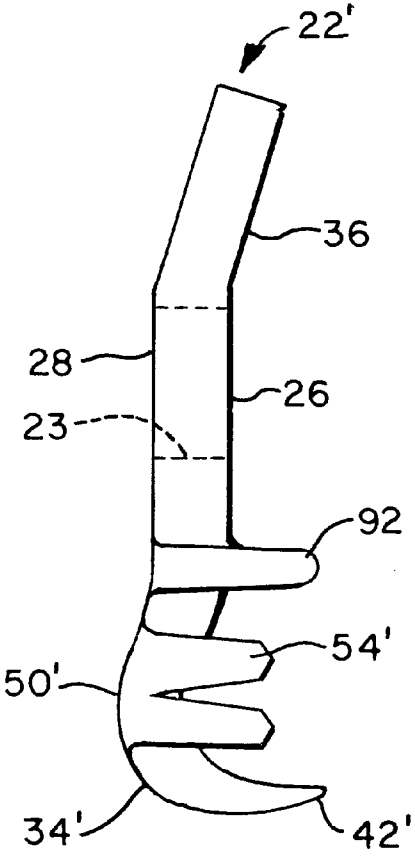
FIG. 10 is a side view, partly in phantom, of the jaw member of FIG. 9.

The first and second member first end portions 34, 38 each comprise opposite side portions 50, 52. The first and second member second end portions 36, 40 are bent outward relative to the first surface 26, 30 to define an inclined surface such that the first and second jaw members 22, 24 pivotally engage along a contact line when they are clamped together (FIG. 2). In the embodiment shown in FIGS. 1–4, 6 and 7, at least one tooth 54, 56 extends outwardly from each side portion 50, 52, relative to the first surface 26, 30. In the embodiment shown in FIGS. 8–10, a projection 92, 94 also extends outwardly from each side portion 50' 52' relative to the first surface 26, 30. The projections 92, 94 are located at a distance from the claws 42 such that the messenger strand 14 may be positioned between them. A clamp 10' in accordance with the second embodiment is therefore self-positioning, facilitating mounting the clamp 10' on the cable 12.

Figure 3:
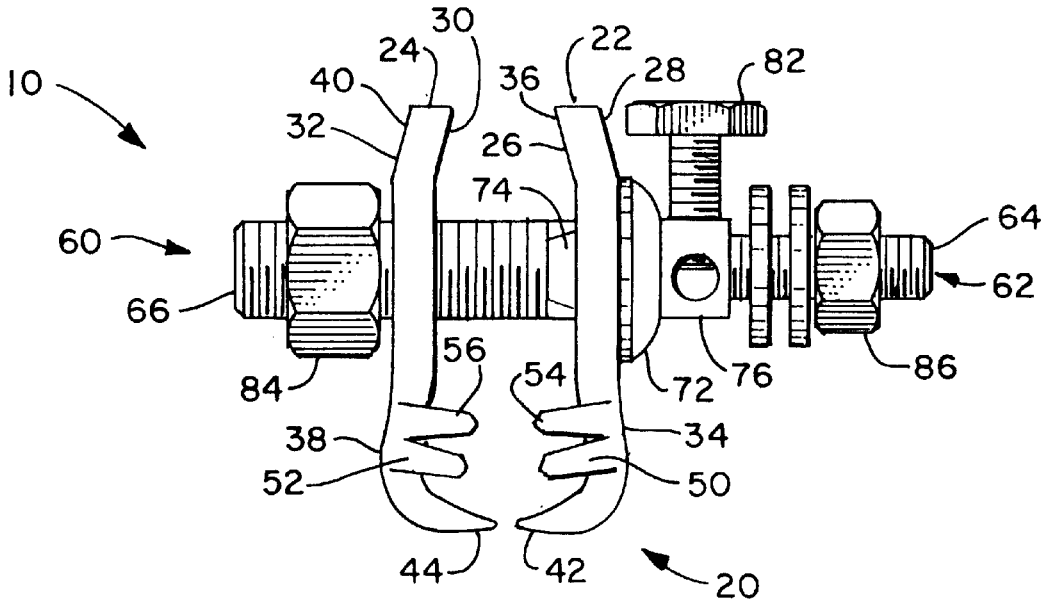
FIG. 3 is an enlarged side view of the clamp of FIG. 1.
Figure 5:
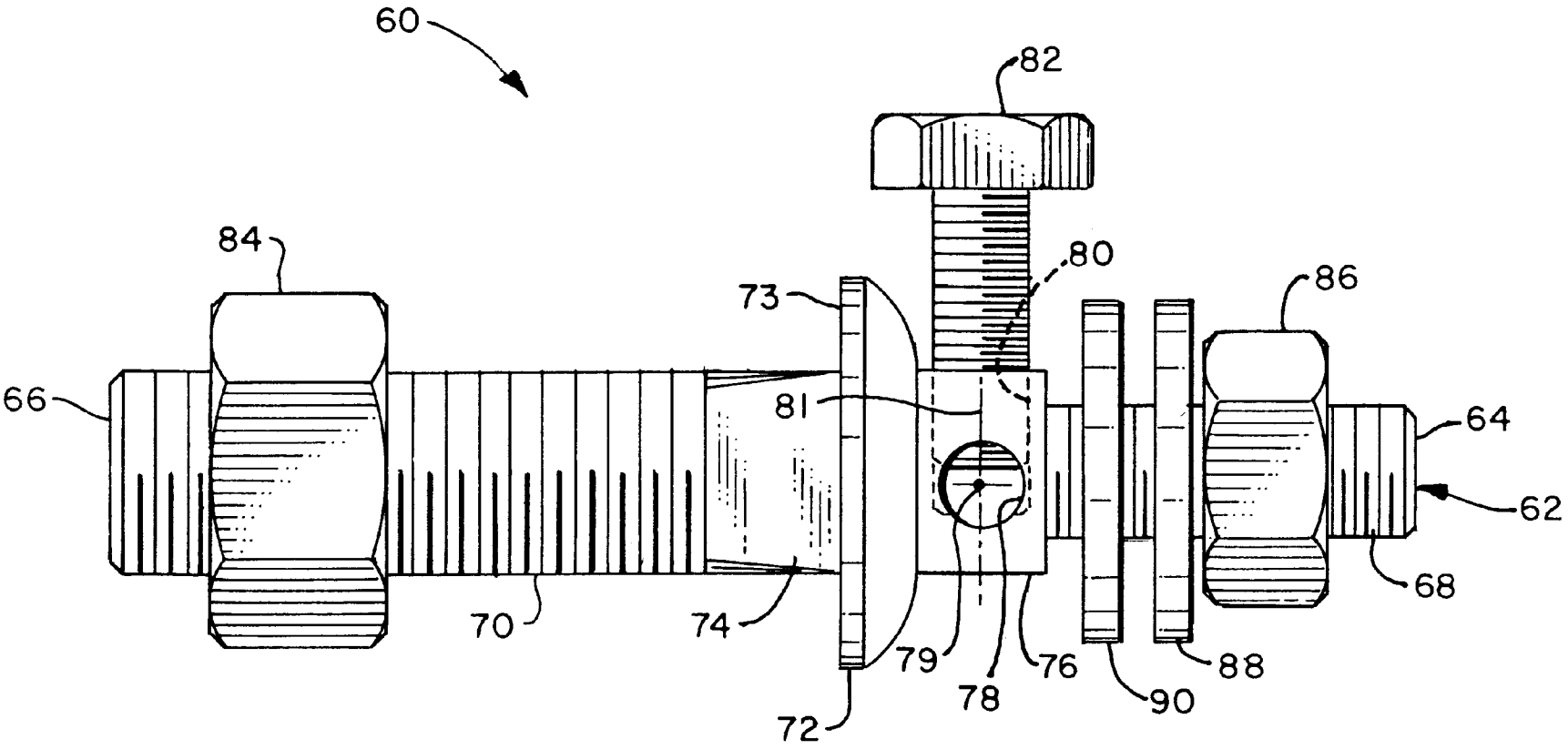
FIG. 5 is an enlarged view of a portion of the clamp of FIG. 1.

With additional reference to FIG. 5, the clamp assembly 60 comprises a stud 62 having opposite first and second ends 64, 66, threaded first and second end portions 68, 70, and an integral flange-shaped portion 72 intermediate the first and second end portions 68, 70 defining a stop. The stop 72 may engage the first member second surface 34 to clamp the first member 22 in position on the stud 62, as shown in FIGS. 3 and 4. The stud 62 extends through openings 23 in the first and second jaw members 22, 24.

In a preferred embodiment, a locating portion 74 laterally extends from the flange surface 73 towards the stud second end 66. The locating portion 74 has a non-circular cross section. In one embodiment the locating portion 74 has a square shape, as shown in FIGS. 3 and 5. The shape of the first member opening 23 is complementary with the cross-section of the locating portion 74. The locating portion 74 is received in the first member opening 23 whereby the inside surface of the opening 23 engages the outside surface of the locating portion 74 and prevents rotational movement therebetween.

Figure 8:
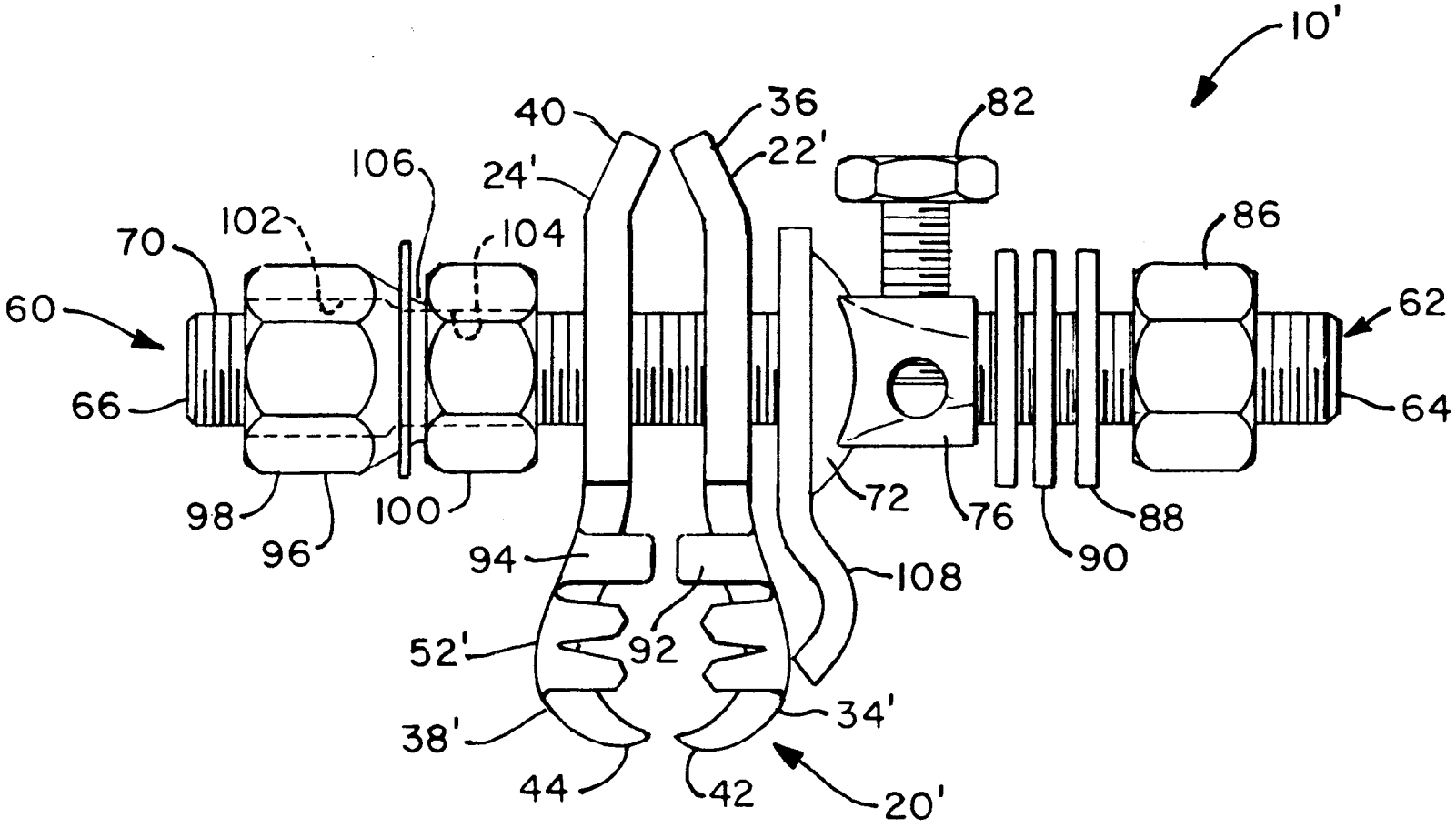
FIG. 8 is a side view of a second embodiment of a combination messenger strand ground and cable lashing wire claim in accordance with the present invention.
Figure 9:
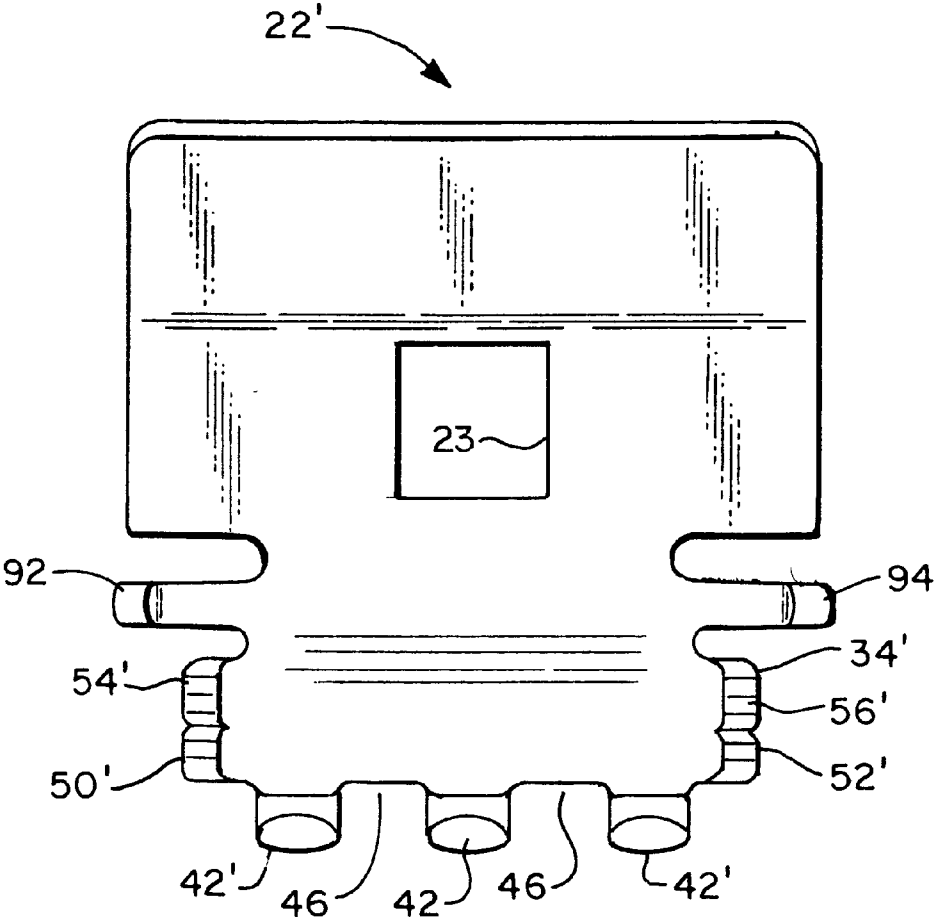
FIG. 9 is an enlarged front view of a jaw member of FIG. 8 viewed from the left thereof.

A first nut 84 is threadably displaceable on the stud second end portion 70 to engage the second surface 32 of the second jaw member 24. Applying a torque to the first nut 84 clamps the first and second members 22, 24 together whereby the messenger strand 14 is clamped between the first and second jaw members 22, 24 so that the claws 42, 44 partially encircle and grip the messenger strand 14, as shown in FIG. 1. The second end portion 36, 40 of the first and second members 22, 24 engage along a line which defines a pivot axis. Continued application of torque causes the first and second member first end portions 26, 30 to pivot about the pivot line thereby causing the teeth 54, 56 to pierce the messenger insulation 15 and thereby engage the messenger conductor 16. As shown in FIG. 8, a breakaway nut 96 may be used to ensure that the proper amount of torque is applied. The breakaway nut 96 has first and second portions 98, 100. The bore 102 of the first portion 98 is unthreaded and has a diameter that is larger than the diameter of the thread on the second end portion 70. The bore 104 of the second portion 100 is threaded for engagement with the thread of the second end portion 70. The thickness of the wall 106 intermediate the first and second portions 98, 100 is selected such that the first portion 98 will break free of the second section 100 when the proper amount of torque has been applied to the nut 96.

The clamp assembly 60 further comprises an integral ground connection head 76 having first and second transverse bores 78, 80. Each bore 78, 80 has an axis 79, 81, first bore axis 79 being substantially perpendicular to the second bore axis 81. A ground wire 18 is received in the first bore 78 and is clamped in place by a bolt 82 which is threadably positionable in the second bore 80. In a preferred embodiment, the first bore 78 is a through bore and the second bore 80 is a partial bore having an interior end that terminates in the first bore 78.

Figure 11:
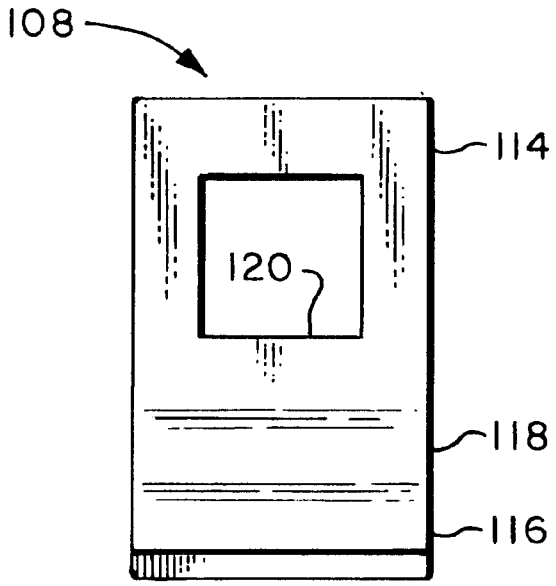
FIG. 11 is an enlarged front view of the ground clip of FIG. 8 viewed from the left thereof.
Figure 12:
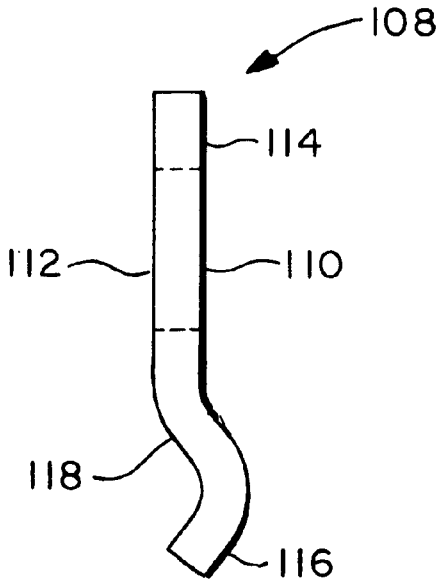
FIG. 12 is a side view of the ground clip of FIG. 11.

When the ground wire 18 is being terminated at the clamp 10, 10', the end portion of the ground wire 18 is received in the first bore 78 and is clamped in place by a bolt 82 which is threadably positionable in the second bore 80. A ground wire 18 that is not being terminated at the clamp 10' may be looped between a clip 108 and jaw member 22' (FIG. 8). Tightening nut 96 causes the jaw member 22' to clamp the ground wire 18 between the jaw member 22' and the clip 108. As shown in FIGS. 8, 11 and 12, the clip 108 has first and second opposite surfaces 110, 112 and first and second opposite end portions 114, 116. The clip first surface 110 is adjacent the surface 73 of the stop 72 and the second surface 112 is adjacent the first member second surface 28. A mid portion 118 of the clip 108 extends obliquely upward from the second surface 112 and the second end portion 116 extends obliquely downward to form a hook-shape for receiving the ground wire 118. The stud 62 extends through an opening 120 in the first end portion 114. The shape of the clip opening 120 is complementary with the cross-section of the locating portion 74. The locating portion 74 is received in the clip opening 120 whereby the inside surface of the opening 120 engages the outside surface of the locating portion 74 and prevents rotational movement therebetween.

A second nut 86 is threadably displaceable on the stud first end portion 68 to engage a first washer 88. As shown in FIG. 5, the stud first end portion 68 may have a smaller diameter than the stud second end portion 70. The lashing wire 19 may be positioned between the first washer 88 and a second washer 90 or looped around the stud 62 between the two washers 88, 90. Applying torque to the second nut 86 causes the first washer 88 to clamp the lashing wire 19 against the second washer 90. The stud first end portion 68 may have a smaller diameter than the stud second end portion 70, as shown in FIG. 5.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A ground clamp for connecting a ground lead to a cable or self-support innerduct having a grounding messenger strand, the messenger strand having an insulated conductor, the ground clamp comprising:

jaw means for gripping the messenger strand, said jaw means comprising first and second opposingly positioned jaw members, each of said jaw members including opposite first and second end portions, opposite first and second sides, and a first surface, the first surface of the first jaw member being disposed adjacent the first surface of the second jaw member, each of said jaw members further including claw means extending from said first end portion for partially encircling and engaging the messenger strand, penetration means extending inwardly relative to said first surface for penetrating the messenger strand insulation and engaging the messenger strand conductor, and first and second projections extending inwardly relative to said first surface from said first and second sides, respectively, said penetration means being disposed intermediate said claw means and said first and second projections;

clamp means engageable with said jaw means for clamping said jaw means to the messenger strand, said clamp means providing an electrical connection with said jaw means; and ground connection means for connecting said clamp means with a ground connector.

2. The ground clamp of claim 1 wherein said first jaw member claw means extend inwardly relative to said first surface of said first jaw member and said second jaw member claw means extend inwardly relative to said first surface of said second jaw member.

3. The ground clamp of claim 1 wherein said first and second projections of said first and second jaw members and said claw means of said first and second jaw members, respectively, define an opening for receiving the messenger strand.

4. The ground clamp of claim 1 further comprising clip means for clamping a ground wire disposed intermediate said jaw means and said clamp means.

5. The ground clamp of claim 4 wherein each of said jaw members comprises means defining an opening, and said clamp means comprises stud means received by said first and second jaw member openings and first nut means threadably engaged on said stud means for engaging said second jaw member, said stud means comprising stop means for engaging said first jaw member, wherein said clip means is disposed intermediate said stop means and said first jaw member.

6. The ground clamp of claim 5 wherein said clip means comprises a clip having a first end portion defining an opening for receiving said stud means and a second end portion extending obliquely from said first end portion.

7. A ground clamp for connecting a ground lead to a cable or self-support innerduct having a grounding messenger strand, the messenger strand having an insulated conductor, the ground clamp comprising:

jaw means for gripping the messenger strand, said jaw means comprising first and second opposingly positioned jaw members, positioning means for positioning the messenger strand within said jaw means, and penetration means for penetrating the messenger strand insulation and engaging the messenger strand conductor, said penetration means providing an electrical connection with the messenger strand, each of said jaw members comprising means defining an opening;

clamp means engageable with said jaw means for clamping said jaw means to the messenger strand, said clamp means providing an electrical connection with said jaw means and comprising stud means received by said first and second jaw member openings and first nut means threadably engaged on said stud means for engaging said second jaw member, said stud means comprising stop means for engaging said first jaw member;

ground connection means for connecting said clamp means with a ground connector; and clip means for clamping a ground wire disposed intermediate said jaw means and said clamp means, said clip means being disposed intermediate said stop means and said first jaw member.

* * * * *